US009975676B2

(12) United States Patent
Chen

(10) Patent No.: US 9,975,676 B2
(45) Date of Patent: May 22, 2018

(54) TABLETOP BOTTLE

(71) Applicant: Franke Technology and Trademark Ltd., Hergiswil (CH)

(72) Inventor: Chi-En Chen, Vancouver (CA)

(73) Assignee: Franke Technology and Trademark Ltd., Hergiswil (CH)

( * ) Notice: Subject to any disclaimer, the term of this patent is extended or adjusted under 35 U.S.C. 154(b) by 0 days. days.

(21) Appl. No.: 15/132,023

(22) Filed: Apr. 18, 2016

(65) Prior Publication Data

US 2016/0332788 A1 Nov. 17, 2016

Related U.S. Application Data

(60) Provisional application No. 62/162,567, filed on May 15, 2015.

(51) Int. Cl.

| | |
|---|---|
| ***B65D 55/02*** | (2006.01) |
| ***B65D 1/02*** | (2006.01) |
| ***B65D 1/06*** | (2006.01) |
| ***B65D 41/04*** | (2006.01) |

(Continued)

(52) U.S. Cl.

CPC ..... *B65D 55/02* (2013.01); *A47G 19/183* (2013.01); *B65D 1/0207* (2013.01); *B65D 1/06* (2013.01); *B65D 41/0478* (2013.01); *B65D 47/0804* (2013.01); *B65D 2501/0081* (2013.01)

(58) Field of Classification Search

CPC ..... B65D 55/02; B65D 55/14; B65D 55/16; B65D 55/04; B65D 1/0207; B65D 1/06; B65D 1/04; B65D 5/48; B65D 25/04; B65D 41/0478; B65D 41/0471; B65D 43/164; B65D 43/16; B65D 47/0804; B65D 47/08; B65D 47/06; B65D 45/08; B65D 45/322; B65D 45/16; B65D 45/24; B65D 45/32; B65D 79/005

USPC ... 215/207, 201, 6, 243, 245, 244, 237, 235, 215/274, 273, 283, 284, 900, 901, 381; 220/321, 320, 319, 315, 326, 324, 833, (Continued)

(56) References Cited

U.S. PATENT DOCUMENTS 3,145,872 A * 8/1964 Hayes ..... B65D 47/148 220/375
3,850,329 A * 11/1974 Robinson ..... B65D 41/3404 215/254

(Continued)

OTHER PUBLICATIONS

The Engineering Tool Box, "Elastic Properties and Young Modulus for Some Materials", https://web.archive.org/web/20061207091925/http://www.engineeringtoolbox.com/young-modulus-d_417.html, Dec. 7, 2006, Table for Polyethylene and Polypropylene.*

(Continued)

*Primary Examiner* — Robert J Hicks
(74) *Attorney, Agent, or Firm* — Oyen Wiggs Green & Mutala LLP

(57) ABSTRACT

A reusable tamper-resistant squeezable tabletop bottle comprises one or more openings sealed by one or more caps and one or more collars. The collars are rotatably secured relative to the body of the bottle by one or more collar receiving shoulders. The caps are axially secured relative to the body by a coupling and the caps are rotatably secured relative to the collars by a locking mechanism. The cap may be removed using a cap removal tool that releases the locking mechanism.

20 Claims, 9 Drawing Sheets

(51) Int. Cl.
*B65D 47/08* (2006.01)
*A47G 19/18* (2006.01)

(58) Field of Classification Search
USPC ..... 220/810, 836, 210, 503, 504; 81/3.57, 81/3.55, 3.41, 3.4
See application file for complete search history.

(56) References Cited

U.S. PATENT DOCUMENTS 3,892,326 A * 7/1975 Schneible ..... B65D 50/046 215/216
5,031,784 A * 7/1991 Wright ..... B65D 50/045 215/211
5,078,296 A * 1/1992 Amidzich ..... B65D 55/16 220/838
5,829,607 A * 11/1998 Ibrahim ..... B65D 1/0223 215/228
6,681,946 B1 * 1/2004 Jansen ..... A61J 1/1406 141/329
D605,522 S * 12/2009 Jaeger ..... D9/449
8,141,731 B2 * 3/2012 Mazurkiewicz ... B65D 47/0814 215/237
2002/0079282 A1 * 6/2002 Harrold ..... B65D 47/0809 215/237
2006/0286324 A1 * 12/2006 Helmenstein ..... B65D 35/08 428/35.7
2015/0225134 A1 * 8/2015 Kato ..... B65D 41/0471 220/214

OTHER PUBLICATIONS

Canadian Intellectual Property Office, Examiner's Report, dated Aug. 29, 2017, issued in Canada Patent Application No. 2,892,351.

* cited by examiner

TABLETOP BOTTLE

CROSS-REFERENCE TO RELATED APPLICATIONS

This application claims the benefit under 35 U.S.C. § 119 of U.S. Application No. 62/162567, filed 15 May 2015, and entitled TABLETOP BOTTLE, which is hereby incorporated herein by reference for all purposes.

TECHNICAL FIELD

This application relates to squeeze bottles, specifically to reusable tamper-resistant squeeze bottles. Embodiments are applicable for serving food such as sauces, condiments and other toppings.

BACKGROUND

Tabletop bottles are commonly found where food is served, such as restaurants and dining halls, for providing sauces, condiments and other toppings for food products. Some tabletop bottles are squeezable (i.e. made of a flexible material) and include a dispensing outlet to allow the contents (i.e. sauce, condiments or other toppings) to be squeezed out of the bottle.

To allow squeezable tabletop bottles to be reused, such bottles typically include a threaded lid that can be removed to allow the bottle to be refilled. This allows restaurants, dining halls and the like to reuse the bottles and purchase their contents in bulk. However, because of the easily removable threaded lid, it is possible for an individual to tamper with the contents of the tabletop bottle by introducing a foreign substance into the bottle.

Some existing condiment bottles have tamper-resistant caps that cannot be easily removed. These bottles are intended and designed for single-use and are generally discarded when empty. These bottles cannot readily be refilled and reused.

In the retail liquor industry, tamper-resistant security devices exist that can be locked over the cap of a liquor bottle. Such devices can only be removed with a key or a tool. These devices discourage easy opening and emptying of the contained liquor. However, these devices do not allow for dispensing of the contents of the bottles nor can they be disassembled or cleaned according to food safety standards.

Preventing tampering with the contents of reusable squeezable tabletop bottles is made more difficult by the squeezable nature of the bottles. In particular, many locking lids are easily removed by deformation of the bottle. Further complications arise due to cleaning and food safety requirements. For example it may be preferred to have a tabletop bottle that is openable from both ends to facilitate cleaning. Accordingly, there remains a need for a practical, reusable, cleanable, squeezable tabletop bottle that is tamper-resistant.

SUMMARY

The invention has a number of aspects. Some aspects provide tamper-resistant tabletop bottles, other aspects provide tools for opening tamper-resistant tabletop bottles and methods for opening and closing tamper-resistant tabletop bottles.

In some embodiments, the tamper-resistant tabletop bottles comprise a body having one or more collar receiving shoulders and a male threaded coupling that defines an opening. The bottle may further comprise a collar which is rotatably secured to the body by the one or more collar receiving shoulders and which comprises a plurality of latch tabs. A cap having a female threaded coupling and a plurality of latch ports may be installed on the body such that the male threads engage the female threads to axially secure the cap and collar to the body and the latch ports engage the latch tabs to rotatably secure the cap to the collar (which is in turn rotatably secured to the body by the one or more collar receiving shoulders).

In some embodiments, the collar, the body and the cap may further comprise one or more additional corresponding protrusions and recesses for securing the collar, the body and the cap relative to one another axially and rotatably.

In some embodiments, the cap may comprise a dispensing outlet. In other embodiments, the tamper-resistant tabletop bottle may comprise a second opening that is closed by a second collar and second cap.

Another aspect provides a tool for removing the cap and collar from the tamper-resistant tabletop bottle. In some embodiments, the tool comprises a squeezable handle and an annular body defining an aperture for receiving the cap therein. Squeezing the handle may cause a plurality of pegs to protrude into the aperture such that when the cap is within the aperture. The plurality of pegs may engage the plurality of latch tabs to release the cap relative to the collar and the body.

Further aspects of the invention and features of example embodiments are illustrated in the accompanying drawings and/or described in the following description.

BRIEF DESCRIPTION OF THE DRAWINGS

The accompanying drawings illustrate non-limiting example embodiments of the invention.

DESCRIPTION

Figure 1:
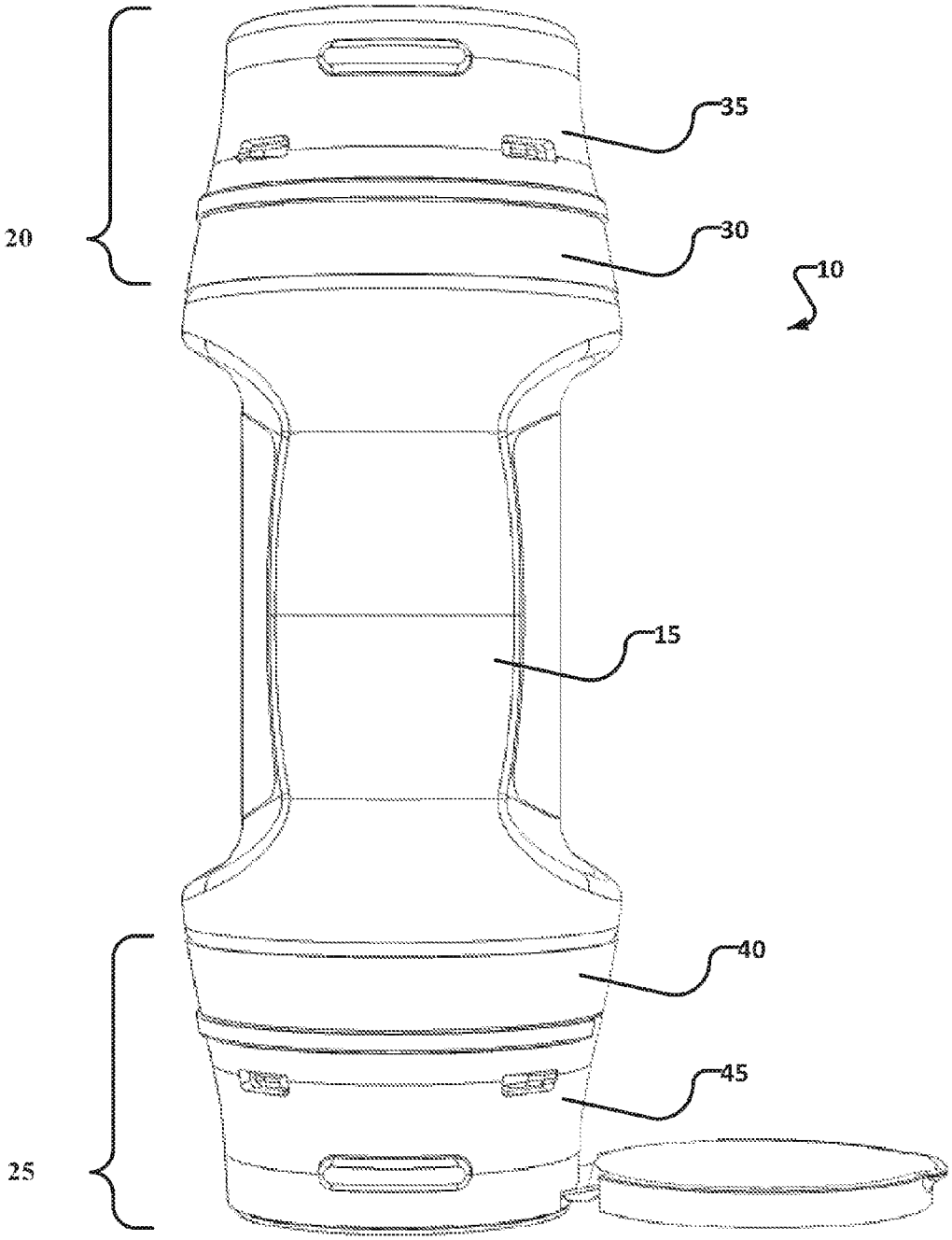
FIG. 1 is a front plan view of a tamper-resistant squeeze bottle according to one embodiment.
Figure 1A:
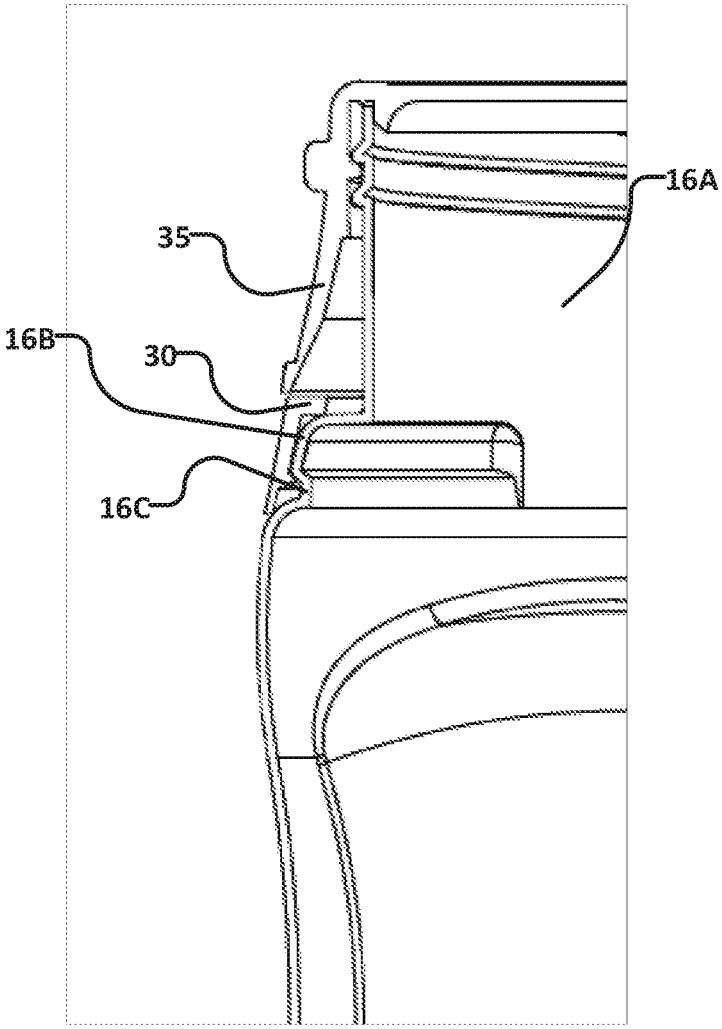
FIG. 1A is a detailed cross-section showing how the collar engages the cap when the collar is snapped onto and secured on the bottle body, and the cap is screwed onto the tamper-resistant squeeze bottle of FIG. 1.

Throughout the following description specific details are set forth in order to provide a more thorough understanding to persons skilled in the art. However, well known elements may not have been shown or described in detail to avoid unnecessarily obscuring the disclosure. The following description of examples of the technology is not intended to be exhaustive or to limit the system to the precise forms of any example embodiment. Accordingly, the description and drawings are to be regarded in an illustrative, rather than a restrictive, sense.

The bottle assemblies described herein generally relate to tamper-resistant, reusable squeeze bottles suitable for dispensing flowable materials such as condiments. One end, or both ends, may be openable using a tool to allow access to an internal cavity of the squeeze bottle for the purposes of cleaning and filling the bottle. When assembled, a lid of the dispenser cap may be opened to provide access to a dispenser outlet. The contents of the bottle (e.g. a condiment) may be ejected through the dispenser outlet by squeezing the body of the bottle.

One aspect of the invention provides a squeeze bottle having a body made of a flexible material and a cap on at least one end of the body. The body includes a cap receiving portion near an opening. The cap receiving portion may have a threaded portion or another locking mechanism (such as a snapping mechanism) that engages with the cap. To prevent someone from squeezing the cap receiving portion to disengage the cap from the body, a collar is provided to protect the cap receiving portion. The material of the collar may be stiffer (i.e. have a higher elastic modulus) than the body to prevent the cap receiving portion from being deformed when the cap and collar is installed.

In some embodiments, when secured individually to the bottle body, the threaded cap can be rotated to remove it from the bottle. Similarly, when secured individually to the bottle body, the collar can be snapped or pulled off axially to remove it from the bottle. However, when the collar is secured to the bottle body and the cap is screwed onto the bottle body and engaged with the collar, the cap is prevented from being rotated by the collar, and the collar is prevented by the cap from being snapped off the bottle axially. The engagement between the cap and collar may require a special tool or key to disengage the cap from the collar.

In some embodiments, the collar may also comprise a mechanism to prevent relative rotation between the body and the cap. For example, the collar may comprise one or more protrusions, indents and/or apertures that engage one or more protrusions, indents and/or apertures on each of the cap and body. In some embodiments, to prevent someone from deforming the body of the bottle to disengage the collar from the body, one or more reinforcements may be provided. For example, the body may comprise a shoulder to stiffen the collar receiving portion of the body.

In some embodiments, the collar may also comprise a mechanism to prevent relative axial movement between the body and the cap. For example, the collar may comprise one or more threads, beads, protrusions, indents and/or apertures that engage one or more threads, beads protrusions, indents and/or apertures on each of the cap and body.

FIG. 1 shows a bottle 10 according to an example embodiment. Bottle 10 comprises a body 15 and a dispenser cap assembly 25. In some embodiments, bottle 10 may also comprise an end cap assembly 20. Dispenser cap assembly 25 and end cap assembly 20 may each be attached to body 15 using a tamper-resistant mechanism, as described in more detail herein.

Bottle 10, as depicted in FIG. 1, comprises body 15, end cap assembly 20 and dispenser cap assembly 25. End cap assembly 20 comprises a collar 30 and an end cap 35. Dispenser cap assembly 25 comprises a collar 40 (which may be identical or substantially similar to collar 30) and a dispenser cap 45.

In the FIG. 1 embodiment, body 15 defines two openings at opposite ends that are respectively accessible by removing end cap assembly 20 and dispenser cap assembly 25. Providing two opposite openings facilitates cleaning and filling of bottle 10 and may allow air to enter bottle 10 as the contents are expelled. This is not mandatory. In some embodiments, body 15 defines only a single opening that is accessible by removing dispenser cap assembly 25 and the opposite end is closed.

Figure 2:
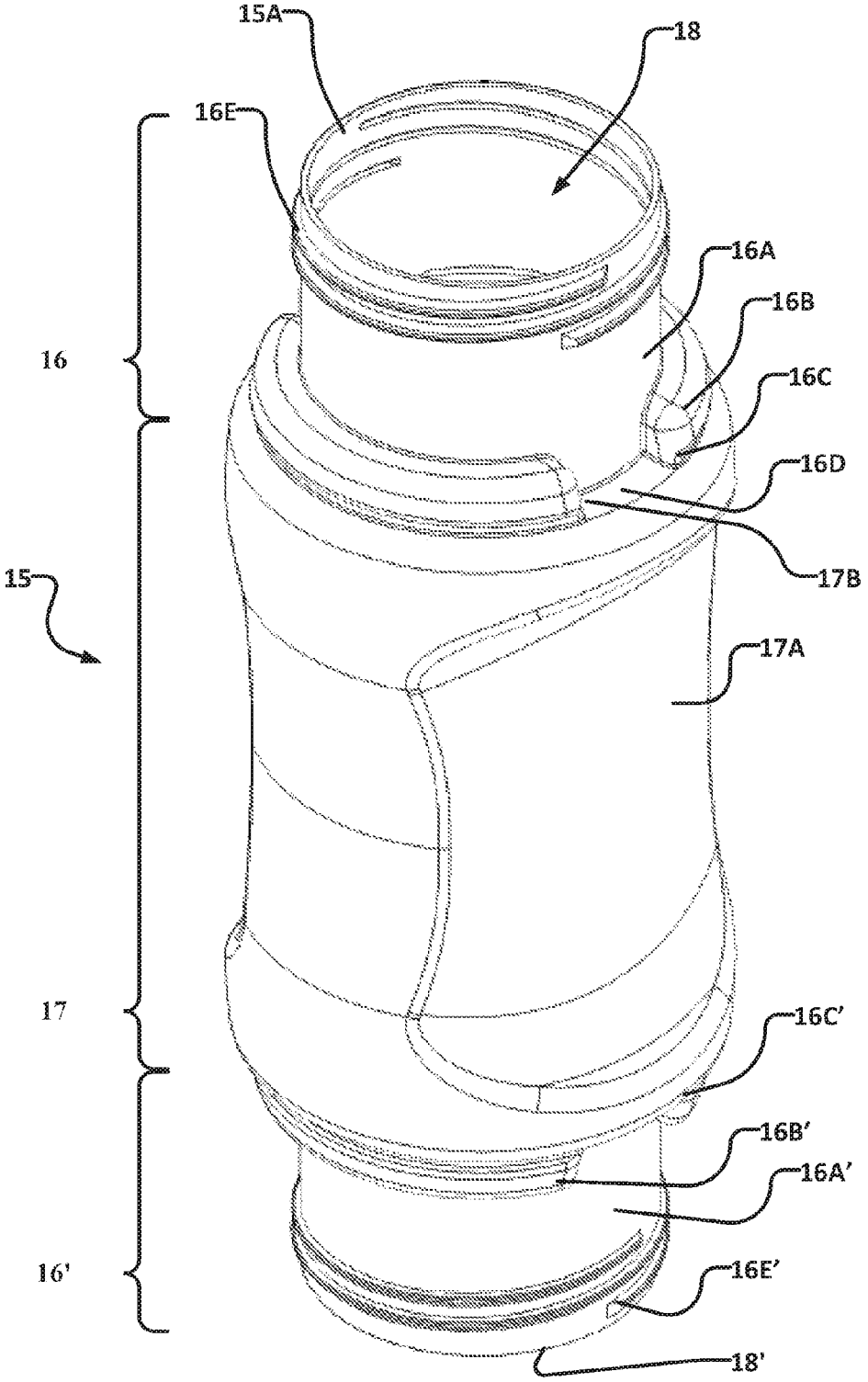
FIG. 2 is an isometric view of the body of the tamper-resistant squeeze bottle of FIG. 1.

FIG. 2 depicts an exemplary embodiment of body 15 of bottle 10. Body 15 may comprise a thin-walled container having a cavity 19 and one or more openings 18, 18'. Body 15 is nominally divided into three sections: cap receiving portion 16, squeezable portion 17 and cap receiving portion 16'. In the FIG. 2 embodiment, cap receiving portion 16 is identical to cap receiving portion 16'. In other embodiments, cap receiving portion 16 may be substantially similar to cap receiving portion 16' or may differ in various ways.

In some embodiments, body 15 comprises a one-piece structure defined by wall 15A. Wall 15A may be of a constant thickness throughout (e.g. to improve ease of manufacture) or may have a thickness that varies (e g thinner near squeezable portion 17 to improve squeezability and thicker near cap-receiving portions 16, 16' to improve tamper resistance). In some embodiments, the thickness of wall 15A may be less than 1 mm. In other embodiments, the thickness of wall 15A may be greater than 1 mm. In some embodiments, the thickness of wall 15A may be between 0.5 mm and 3 mm. In some embodiments, the thickness of wall 15A is approximately 0.7 mm, 0.8 mm, 1.0 mm, 1.3 mm or 1.5 mm.

In an example embodiment, body 15 comprises a material having an elastic modulus of less than 1.0 GPa. In some embodiments, body 15 may comprise a material having an elastic modulus between approximately 0.1 GPa and 3.0 GPa. In some embodiments, body 15 is made of a material having an elastic modulus of 0.45 GPa, 0.6 GPa or 0.8 GPa.

In some embodiments, body 15 is made of a curable material. Body 15 may be made of a polymer material such as, but not limited to, polyethylene (low density, medium density or high density), polypropylene, polyethylene terephthalate or another suitable polymer material. In other embodiments, body 15 may comprise more than one material. In some embodiments, polyethylene is used because it exhibits more flexibility (i.e. has a lower elastic modulus) than polypropylene and therefore improves the squeezability of body 15. Body 15 may be fabricated using blow molding, injection molding, injection blow molding, extrusion blow molding, extrusion or a like method.

Cavity 19 of body 15 may hold a fluid or fluid-like content, such as a condiment for dispensing through a dispenser outlet. Cavity 19 is defined primarily by body 15 and in part by end cap 35 and dispenser cap 45. Cavity 19 may vary in size depending on the size of body 15 and the thickness of wall 15A.

Squeezable portion 17 may have a generally cylindrical cross-section or may be shaped ergonomically to facilitate use. Various squeeze bottle shapes are known in the art and it should be understood that any such shape would be suitable for squeezable portion 17.

FIG. 2 depicts one exemplary embodiment of squeezable portion 17 having a substantially hourglass shape. In cross section, squeezable portion 17 is substantially circular at a first end near cap receiving portion 16, substantially oblong through the center and substantially circular at the opposite end near cap receiving portion 16'. The oblong cross-section center may be easier to grip by a hand and improves the squeezability of squeezable portion 17 by encouraging a user to squeeze the broad side of squeezable portion 17 as opposed to the narrow sides of squeezable portion 17 (which have a smaller radius of curvature and are thus more difficult to squeeze). The circular cross-section improves rigidity of body 15. In particular, the circular cross-section improves the rigidity of cap receiving portions 16, 16' since wall 15A draws inwardly in a transverse direction to form lip 17B. Lip 17B reduces the diameter of cavity 19 and provides radial rigidity to body 15. Squeezable portion 17 may include a label section 17A shaped to define a surface for receiving a label or for being printed on directly. This is not mandatory.

Cap receiving portion 16 of body 15 extends axially from squeezable portion 17. In particular, cap receiving portion 16 extends axially from lip 17B. Like the end of squeezable portion 17, cap receiving portion 16 is generally circular in cross-section. As can be seen from FIG. 2, cap receiving portion 16 comprises, tubular portion 16A, shoulder 16B, bead seats 16C, key seat 16D and male threads 16E.

As depicted in FIG. 2, tubular portion 16A extends from the edge of lip 17B and is circular in cross section. The axial length of tubular portion 16A may vary depending on the size of bottle 10. In some embodiments, tubular portion 16A is relatively longer so as to isolate threads 16E from squeezable portion 17. In this way, squeezing squeezable portion 17 will not deform threads 16E and bottle 10 is more tamper resistant. Tubular portion 16A should have sufficient axial length to accommodate installation of both collar 30 and end cap 35.

In some embodiments, the axial length of tubular portion 16A allows cap 35 to engage threads 16E before engaging latch tabs 32. This is for ease-of-use and ease of assembly. This prevents the user from needing additional force to push cap 35 axially towards the body 15 and deform latch tabs 32 in order to subsequently engage the threads 16E. Instead, when threads 16E are engaged first, the user can simply continue to rotate cap 35 and thread the cap 35 onto body 15. As cap 35 rotates, it also advances axially onto body 15, engages latch tabs 32 and gradually deforms latch tabs 32 until they seat into the latch ports 36. In this way, the axial length of tubular portion 16A may depend on the size of latch tabs 32.

Male threads 16E are located on tubular portion 16A. Male threads 16E may comprise dual starting threads such as depicted in FIG. 2, although this is not mandatory. The number of thread starts, like the number of threads per inch, the depth of the threads, the pitch of the threads and other features of the threads are not critical and can be varied as desired.

Figure 3:
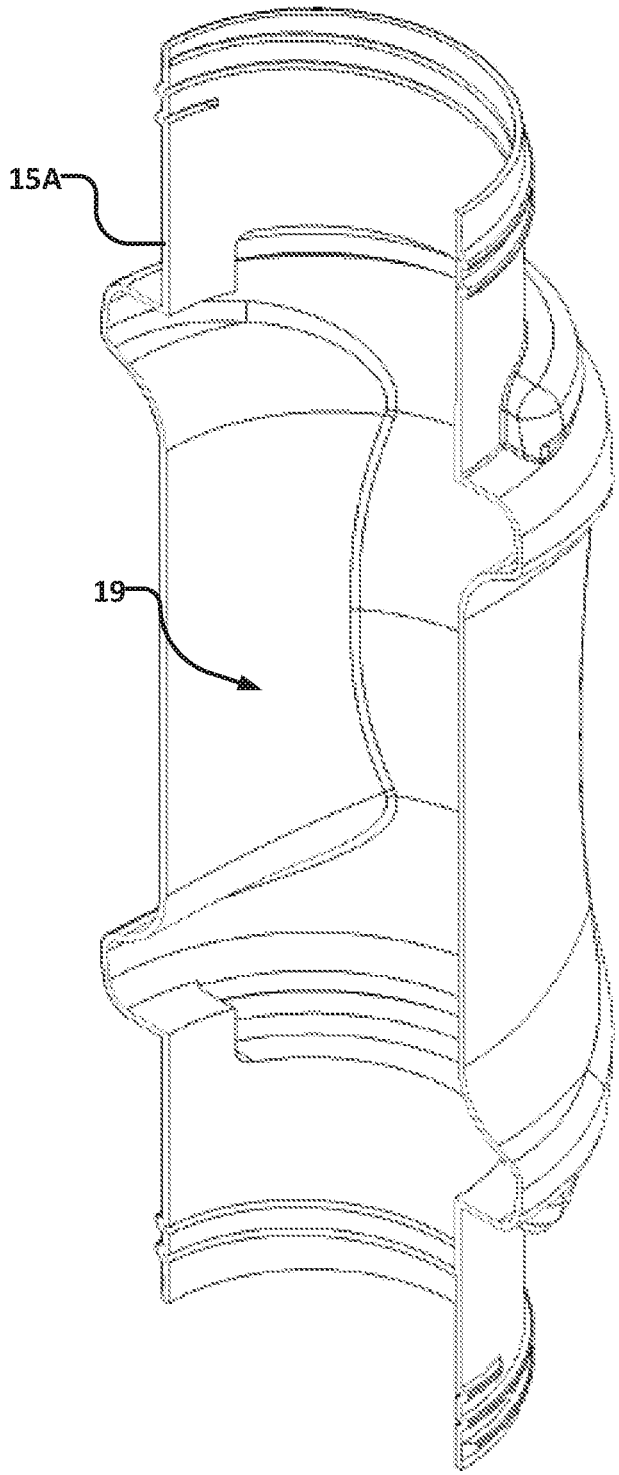
FIG. 3 is an isometric cross-section of the body of the tamper-resistant squeeze bottle of FIG. 1.

Shoulders 16B protrude from tubular portion 16A and lip 17B to improve radial rigidity of cap receiving portion 16 and to mate with collar 30. As depicted in FIG. 3, shoulders 16B are hollow and define a portion of cavity 19. In other embodiments, shoulders 16B may be solid, ribbed or reinforced with additional material. Shoulders 16B extend partially around the circumference of cap receiving portion 16. In the illustrated embodiment, two shoulders 16B are circumferentially separated to form two key seats 16D. In other embodiments, there may be more than two shoulders 16B that form more than two key seats 16D. As discussed herein, key seats 16D mate with keys 30B of collar 30 to rotatably secure collar 30 to body 15.

Shoulders 16B also define bead seats 16C between lip 17B and shoulders 16B. As will be discussed below, bead seats 16C mate with collar 30 to axially secure collar 30 to body 15 in addition to the axial security of collar 30 provided by cap 35. Each bead seat 16C extends along substantially the entire length of a particular shoulder 16B. In some embodiments, each bead seat 16C does not extend the entire length of a particular shoulder 16B and thereby also rotatably secures collar 30 to body 15 when beads 30D of collar 30 engages bead seats 16C.

Cap receiving portion 16' may be identical to cap receiving portion 16, as described above, or may have variations. For example, in some embodiments, the number of shoulders 16B may be different from the number of shoulders 16B', the diameter of tubular portion 16A may be different from the diameter of tubular portion 16A', the width of key seat 16D may be different than the width of key seat 16D', the shape of threads 16E may be different than the shape of threads 16E' and/or the size of bead seats 16C may be different than the size of bead seats 16C'. Such variance between cap receiving portion 16 and cap receiving portion 16' may ensure that the correct cap (e.g. dispenser cap 45 or end cap 35) is installed on each cap receiving portion 16, 16'. In other embodiments, the caps (e.g. dispenser cap 45 and end cap 35) are interchangeable.

Cap receiving portions 16, 16' define openings 18, 18'. In FIG. 2 the diameter of opening 18 is depicted as being relatively large in relation to the maximum diameter of body 15. This is not mandatory. In some embodiments, the diameter of opening 18 may be relatively smaller or even relatively larger. In some embodiments, it is desired that openings 18, 18' are relatively large to facilitate cleaning and filling of bottle 10. For example, in some embodiments, openings 18, 18' are at least 4 cm in diameter. However, the diameter of openings 18, 18' may vary in relation to the dimensions of bottle 10 generally.

FIG. 3 depicts a cross-section of body 15. As can be seen from FIG. 3, wall 15A is generally uniform in thickness throughout body 15. In other embodiments, wall 15A may be thicker in some regions. For example, wall 15A could be thicker in and around cap receiving portions 16, 16'. Accordingly, cavity 19 has substantially the same shape as the outer shape of body 15.

In general, the squeezability of body 15 can be controlled (at least in part) by changing, for example, one or more of: the thickness of wall 15A, the material of wall 15A, the radius of curvature of the portion to be squeezed and the number and shape of reinforcements (e.g. shoulders 16B or lip 17B. In some embodiments, it is desirable to increase the squeezability of body 15 to facilitate expelling high viscosity contents (such as honey) or it may be desirable to decrease the squeezability of body 15 to decrease the rate of expulsion of low viscosity contents (such as soy sauce) and to improve tamper-resistance.

One difficulty with making a squeezable bottle, of the general type shown in FIG. 1, tamper-resistant is that it is difficult to mass produce bodies 15 that have significantly different characteristics in different parts. For example, it is difficult to mass produce bodies 15 having varying thickness or varying material characteristics. If the material of body 15 is selected to make squeezable portion of body 17 very flexible and easy to squeeze then the use of the same materials for cap-receiving portions 16, 16' may allow for a user to deform cap-receiving portions 16, 16' inwardly so that a cap, even a normal anti-tamper cap, could be removed undesirably easily by deforming one of portions 16, 16' enough to pull off the corresponding cap. One way to prevent such tampering is to minimize the diameter of the openings (e.g. openings 18, 18'), thereby reducing the radius of curvature and effectively stiffening cap-receiving portions 16, 16'. However, minimizing the diameter of the openings can make it more difficult to clean and fill bottle 15 and/or to expel the contents of bottle 15. In the illustrated embodiments, collars 30, 40 serve to prevent such tampering while allowing for relatively large (in relation the maximum diameter of bottle 15) openings 18, 18' without requiring cap-receiving portions 16, 16' to have very different material characteristics from the rest of body 15.

Figure 4:
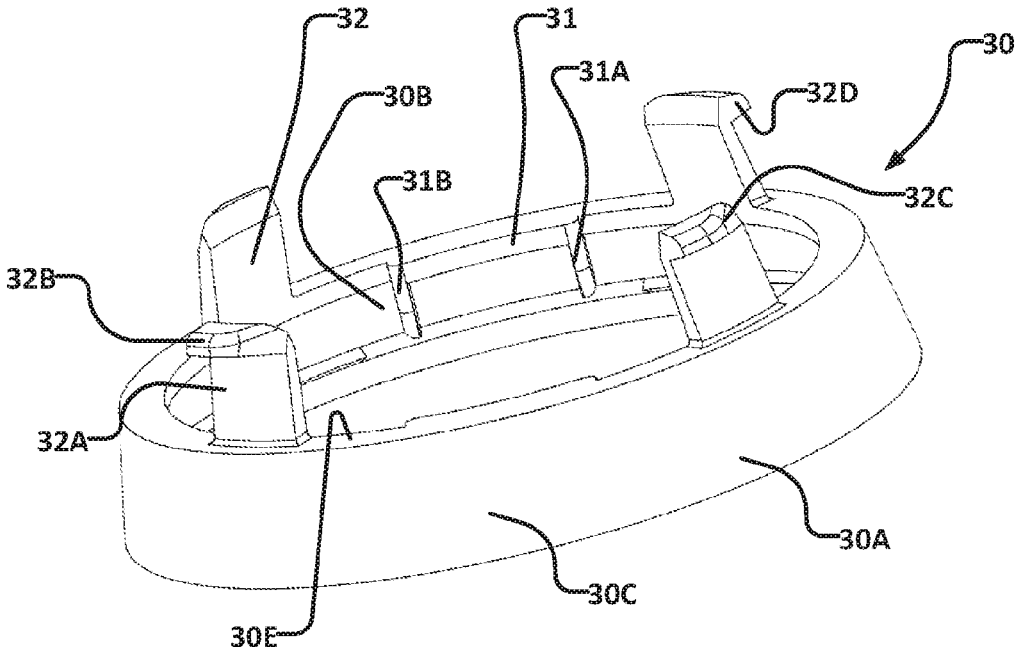
FIG. 4 is an isometric view of a collar of the tamper-resistant squeeze bottle of FIG. 1.

FIG. 4 depicts a collar 30 or a collar 40. For convenience, and without loss of generality, the FIG. 4 collar will be referred to herein as collar 30. Collar 30 comprises a collar body 30A having a generally annular shape with an inner surface 30B and an outer surface 30C. The shape of collar body 30A may vary. For example, collar body 30A may be generally cylindrical (i.e. having the same transverse cross-section throughout) or it may be conical (i.e. having a transverse cross-section that diminishes along an axial dimension), as depicted in FIG. 4.

Collar 30 further comprises one or more keys. The figure shows a plurality of keys 31 that protrude from inner surface 30A, a lip 30E that protrudes radially inward from collar body 30A, one or more beads 30D that protrude radially inward from inner surface 30B and a plurality of latch tabs 32 that protrude generally axially outward from lip 30E.

Keys 31 protrude from inner surface 30B of collar 30 and correspond to key seats 16D in number, size and in shape. Keys 31 may engage key seats 16D to provide a snug fit that prevents rotational movement between collar 30 and body 15. Each key 31 may comprise a pair of tabs 31A, 31B for contacting key seat 16D. Alternatively, keys 31 may be solid. Tabs 31A, 31B may be reinforced by one or more ribs (not shown) between tabs 31A, 31B.

Inner surface 30B may further comprise one or more beads 30D which protrude from inner surface 30B. Beads 30D may extend around the entire circumference of inner surface 30B or may stop at or near each key 31. Beads 30D may improve radial stiffness of collar 30 thereby improving the tamper-resistance of bottle 10. Beads 30D may be shaped and sized to correspond to bead seats 16C such that when collar 30 is installed on body 15 and keys 31 engage key seats 16D, beads 30D protrude into bead seats 16C thereby securing collar 30 axially relative to body 15 (additional axial security of collar 30 relative to body 15 is provided by cap 35). Installing collar 30 onto body 15 may require some deformation of beads 30D and/or shoulder 16B to allow beads 30D to fit past shoulder 16B before protruding into bead seats 16C. The fit between beads 30D and seats 16C may comprise a snap-fit.

In the FIG. 4 embodiment, latch tabs 32 extend axially away from collar 30. In particular, latch tabs 32 protrude from lip 30E. This is not mandatory. In other embodiments, latch tabs 32 may protrude from collar body 30A directly or another part of collar 30. Latch tabs 32 comprise a first portion 32A extends from lip 30E. First portion 32A may be generally rectangular in cross-section as depicted in FIG. 4, although this is not mandatory. A hook portion 32B extends from the distal end of first portion 32A.

First portions 32A may extend from lip 30E in a direction substantially parallel with outer surface 30C, as shown in FIG. 4. This is not mandatory. In other embodiments, first portion 32A may extend generally in an axial direction or more toward the center of collar 30.

Figure 5:
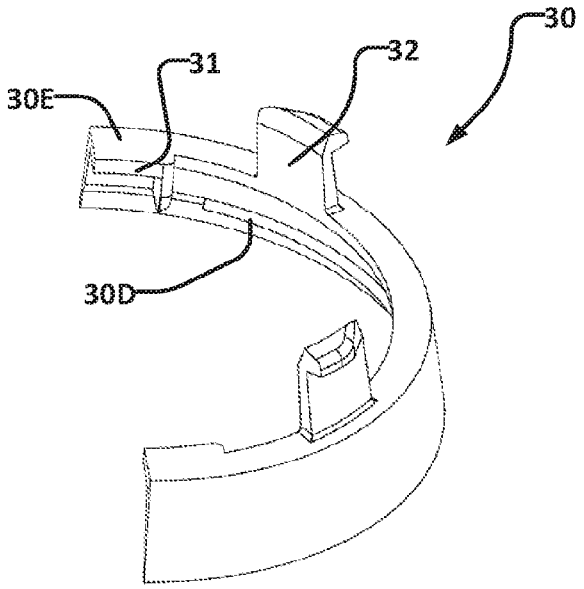
FIG. 5 is an isometric cross-section of the collar of FIG. 4.

Hook portions 32B extend generally radially outward from first portions 32A. For example, as depicted in FIG. 5, hook portions 32B extend at approximately 90° from first portions 32A. Hook portions 32B may be rounded, angular or a combination of both. In some embodiments, hook portions 32 may include bevelled edges 32C and square edges 32D. Bevelled edges 32C may allow for easier rotation of dispenser cap 45 or end cap 35 in a cap-tightening direction while square edges 32D may be angular to hinder rotation of dispenser cap 45 or end cap 35 in a cap-loosening direction and to lockingly engage with latch ports 36.

Collar 40 may be substantially similar to collar 30. Collar 40 may exhibit similar or identical features as described above in relation to collar 30 and such similar or identical features would be apparent to those skilled in the art upon reading the description and understanding the figures herein. For example, and without limitation, collar 40 may comprise latch tabs 32 which are substantially similar to latch tabs 32 of collar 30, keys 31 which are substantially similar to keys 31 of collar 30 and beads 30D which are substantially similar to beads 30D of collar 30. Collar 40 may engage body 15 and dispenser cap 45 in a substantially similar manner as collar 30 engages body 15 and end cap 35. In other embodiments, features and/or dimensions of collar 30 may differ from features of collar 40 so as to differentiate between the two.

In some embodiments, collars 30, 40 are made of a material having an elastic modulus of at least 0.8 GPa. In some embodiments, collars 30, 40 are made of a material having an elastic modulus between approximately 0.45 GPa and 4.0 GPa. In some embodiments, collars 30, 40 are made of a material having an elastic modulus of between 1.5 GPa and 2.0 GPa. In some embodiments, collars 30, 40 may be made of a curable material. A polymer material may be used, such as, but not limited to, polyethylene (low density, medium density or high density), polypropylene, polyethylene terephthalate or a similar material. In some embodiments, polypropylene is used because it exhibits less flexibility (i.e. a higher elastic modulus) than polyethylene and therefore improves the stiffness of collars 30, 40 thereby improving the tamper-resistance of bottle 10. Collars 30, 40 may be made using any suitable technique. In some embodiments, collars 30, 40 are made using blow molding, injection molding, injection blow molding, extrusion blow molding.

Figure 6:
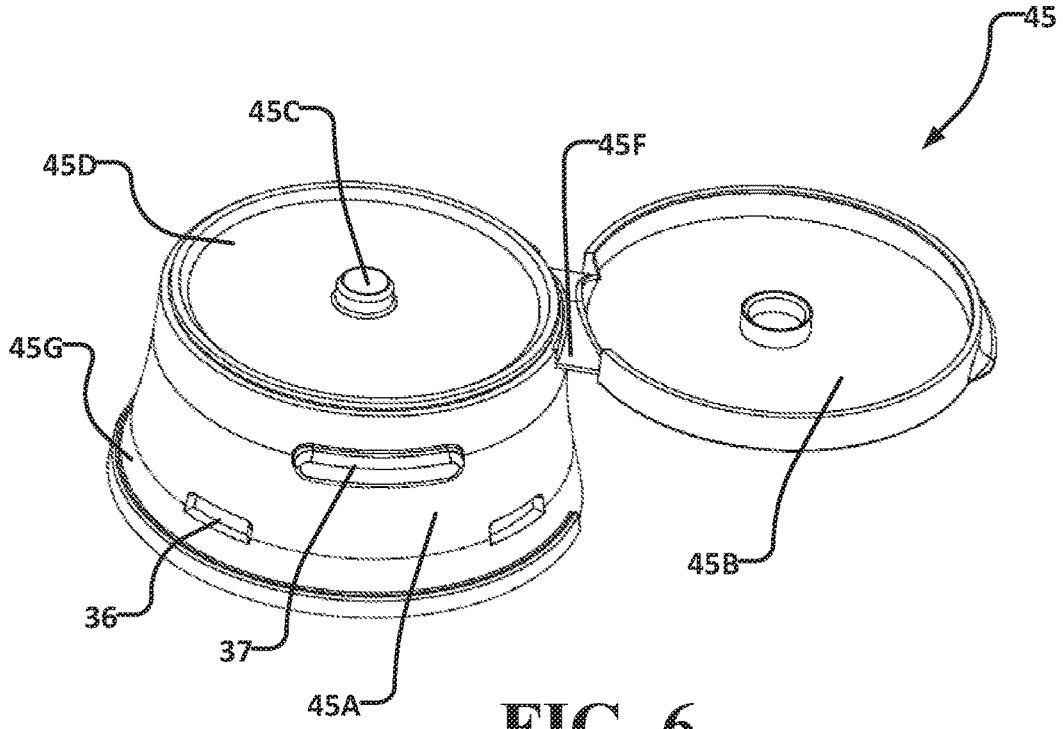
FIG. 6 is an isometric view of a dispenser cap of the tamper-resistant squeeze bottle of FIG. 1.

FIG. 6 depicts an exemplary embodiment of a dispenser cap 45 in an open position. Dispenser cap 45 comprises a dispenser cap body 45A that is generally tubular in shape. Like collar body 30A, dispenser cap body 45A may be generally cylindrical (i.e. having the same transverse cross-section throughout), conical (i.e. having a transverse cross-section that diminishes along an axial dimension), or partially cylindrical and partially conical (i.e. having a portion that has the same transverse cross-section throughout and a tapered portion 45G that has a transverse cross-section that diminishes along an axial dimension) as depicted in FIG. 6. The portion of dispenser cap body 45A that abuts against collar 40 may have a first inner diameter that corresponds to an inner and/or outer diameter of collar 40.

Dispenser cap 45 may comprise one or more female threads 45E for mating with male threads 16E' of body 15 of bottle 10. Female threads 45E may comprise dual starting threads, although this is not mandatory. The number of thread starts, like the number of threads per inch, the depth of the threads, the pitch of the threads and other features of the threads are not critical and can be varied accordingly so long as they correspond with male threads 16E'.

Dispenser cap body 45A may define one or more latch ports 36. Latch ports 36 may comprise cut-outs or apertures in dispenser cap body 45A such as depicted in FIG. 6. Latch ports 36 are shaped and sized to correspond with latch tabs 32 when female threads 45E are securely engaged with male threads 16E'.

In this way, while threading dispenser cap 45 onto body 15 (with collar 40 previously installed) latch tabs 32 are deformed radially inwardly by tapered portion 45G such that as dispenser cap 45 is threaded further onto body 15, latch tabs 32 are increasingly deformed radially inwardly. Once latch tabs 32 align (both axially and circumferentially) with latch ports 36, hook portions 32B of latch tabs 32 protrude into (and possibly through) corresponding latch ports 36 due to restorative deformation of latch tabs 32. The fit between latch tabs 32 and latch ports 36 may comprise a snap-fit.

The engagement of latch tabs 32 into latch ports 36 prevents relative axial movement between collar 40 and dispenser cap 45 and prevents relative rotational movement between collar 40 and dispenser cap 45. Due to relative rotational movement between collar 40 and body 15 being arrested by keys 31 and key seats 16D', the engagement of latch tabs 32 into latch ports 36 effectively prevents relative rotational movement between body 15 and dispenser cap 45. The engagement of male threads 16E and female threads 45E further prevents relative axial movement between body 15 and dispenser cap 45. In this way, dispenser cap 45 is securely attached to body 15 thereby preventing tampering with the contents of bottle 10.

Similarly, due to relative axial movement between body 15 and dispenser cap 45 being arrested by male threads 16E and female threads 45E, the engagement of latch tabs 32 into latch ports 36 effectively prevents axial movement between collar 40 and body 15. In this way, collar 40 is securely attached to body 15 thereby preventing tampering with the contents of bottle 10 and preventing the collar from being loosened from body 15 when body 15 is squeezed forcefully and even if dramatically deformed.

Figure 7:
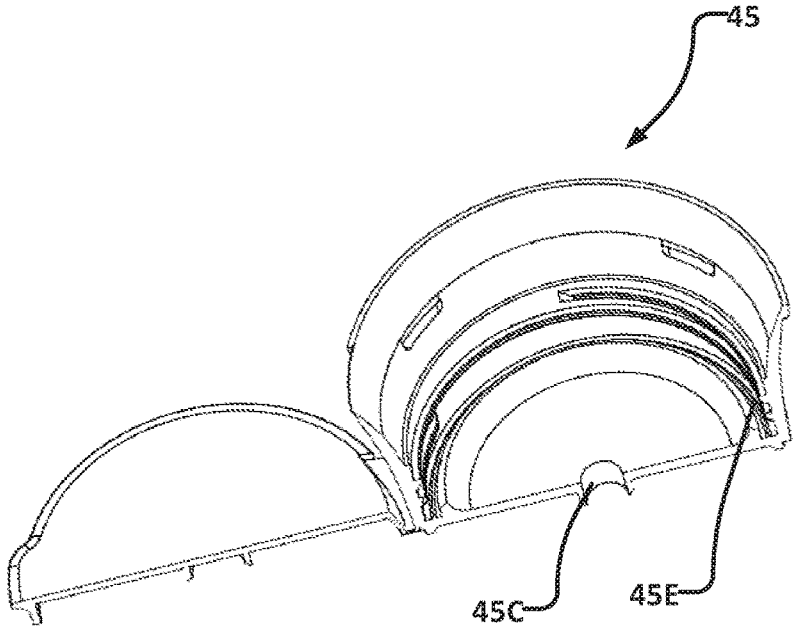
FIG. 7 is an isometric cross-section of the dispenser cap of FIG. 6.

One end of dispenser cap body 45A is closed off by outlet surface 45D. Outlet surface 45D extends across an axial opening defined by dispenser cap body 45A as depicted in FIGS. 6 and 7. A dispensing outlet 45C may be defined by outlet surface 45D such as is shown in FIG. 7. Dispensing outlet 45C may be pressure operated (i.e. it may open when body 15 is squeezed thereby increasing the pressure within bottle 10. Dispensing outlet 45C may be circular in shape and may include a protruding lip as depicted in FIG. 7, but this is not mandatory. In other embodiments, dispensing outlet 45C may take the shape of any known outlet for dispensing such as is known in the art.

In some embodiments, dispenser cap 45 may further comprise a lid 45B. Lid 45B may serve to protect dispensing outlet 45C from contamination such as dust or dirt, during storage and prevent leaking through dispensing outlet 45C. Lid 45B may be attached to dispensing cap 45 by a hinge 45F such as depicted in FIGS. 6 and 7. In alternative embodiments, lid 45B may be attached by threads, snaps, a bead lock, magnets or any other suitable closure system.

In some embodiments, dispenser cap 45 may further comprise one or more bossed keys 37. Bossed keys 37 may protrude radially outwardly from dispenser cap body 45A at one or more circumferential locations. Bossed keys 37 may improve the ease with which a tool 75 may be engaged with dispenser cap 45, as described in more detail below. Bossed keys 37 may be of various shapes and sizes to engage with corresponding channels 75E of tool 75

In some embodiments, dispenser cap 45 is made of a material having an elastic modulus of at least 0.8 GPa. In some embodiments, collars 30, 40 are made of a material having an elastic modulus between approximately 0.45 GPa and 4.0 GPa. In some embodiments, dispenser cap 45 is made of a material having an elastic modulus of between 1.5 GPa and 2.0 GPa. In some embodiments, dispenser cap 45 may be made of a curable material. A polymer material may be used, such as, but not limited to, polyethylene (high density), polypropylene, acrylonitrile butadiene styrene, nylon or a similar material. In some embodiments, polypropylene is used because it exhibits less flexibility (i.e. a higher elastic modulus) than polyethylene and therefore improves the stiffness of dispenser cap 45 thereby improving the tamper-resistance of bottle 10. Dispenser cap 45 may be made using any suitable technique. In some embodiments, dispenser cap 45 is made using blow molding, injection molding, injection blow molding, extrusion blow molding.

Figure 8:
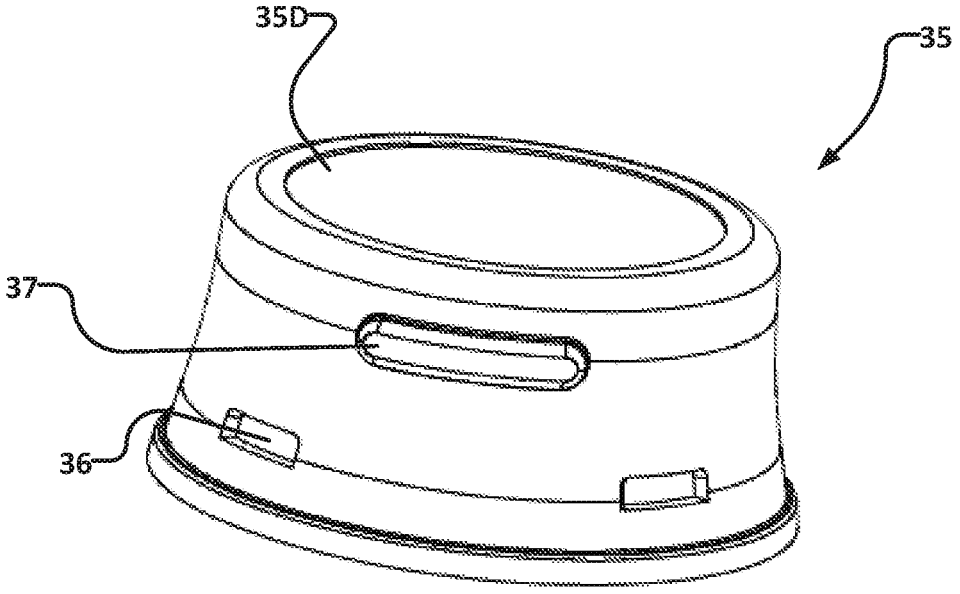
FIG. 8 is an isometric view of an end cap of the tamper-resistant squeeze bottle of FIG. 1.

FIG. 8 depicts an end cap 35. End cap 35 may be substantially similar to dispenser cap 45 although it differs in that it does not include a dispensing outlet (it may instead include a vent, such as a one-way valve), a hinge or a lid. In other respects, end cap 35 may exhibit similar or identical features as described above in relation to dispenser cap 45 and such similar or identical features would be apparent to those skilled in the art upon reading the description and understanding the figures herein. For example, and without limitation, end cap 35 may comprise latch ports 36 similar to latch ports 36, bossed keys 37 similar to bossed keys 37 of end cap 35, female threads 35E similar to female threads 45E and tapered portion 35G similar to tapered portion 45G. End cap 35 may also comprise an end cap surface 35D that is substantially similar to outlet surface 45D except that it does not include a dispensing outlet. End cap 35 may be installed and removed from body 15 and collar 30 in substantially the same way as dispenser cap 45 and collar 40. End cap 35 may be secured to body 15 and collar 30 in substantially the same way as dispenser cap 45 and collar 40.

In some embodiments, end cap 35 may differ from dispenser cap 45 in one or more ways so as to ensure that end cap 35 can only be installed on cap receiving portion 16 and that dispenser cap 45 can only be installed cap receiving portion 16'. For example, cap receiving portion 16, collar 30 and end cap 35 may have male and female threads having different geometries or may have more or less latch tabs 32 and latch ports 36 than cap receiving portion 16', collar 40 and dispenser cap 45.

As with dispenser cap 45 and collar 40, engagement of latch tabs 32 into latch ports 36 prevents relative axial movement between collar 30 and end cap 35 and prevents relative rotational movement between collar 30 and end cap 35. Due to relative rotational movement between collar 30 and body 15 being arrested by keys 31 and key seats 16D, the engagement of latch tabs 32 into latch ports 36 effectively prevents relative rotational movement between body 15 and end cap 35. The engagement of male threads 16E and female threads 35E further prevents relative axial movement between body 15 and end cap 35. In this way, end cap 35 is securely attached to body 15 thereby preventing tampering with the contents of bottle 10.

Similarly, due to relative axial movement between body 15 and dispenser cap 45 being arrested by male threads 16E and female threads 45E, the engagement of latch tabs 32 into latch ports 36 effectively prevents axial movement between collar 40 and body 15. In this way, collar 40 is securely attached to body 15 thereby preventing tampering with the contents of bottle 10 and preventing the collar from being loosened from body 15 when body 15 is squeezed forcefully and even if dramatically deformed.

In some embodiments, end cap 35 is made of a material having an elastic modulus of at least 0.8 GPa. In some embodiments, collars 30, 40 are made of a material having an elastic modulus between approximately 0.45 GPa and 4.0 GPa. In some embodiments, end cap 35 is made of a material having an elastic modulus of between 1.5 GPa and 2.0 GPa. In some embodiments, end cap 35 may be made of a curable material. A polymer material may be used, such as, but not limited to, polyethylene (high density), polypropylene, acrylonitrile butadiene styrene, nylon or a similar material. In some embodiments, polypropylene is used because it exhibits less flexibility (i.e. a higher elastic modulus) than polyethylene and therefore improves the stiffness of end cap 35 thereby improving the tamper-resistance of bottle 10. End cap 35 may be made using any suitable technique. In some embodiments, end cap 35 is made using blow molding, injection molding, injection blow molding, extrusion blow molding.

When dispenser cap assembly 25 and end cap assembly 20 are installed on body 15, bottle 10 may be used for dispensing its contents. The contents of bottle 10 may be accessed by opening lid 45B and squeezing body 15 thereby forcing the contents through dispensing outlet 45C. Tampering with the contents inside bottle 10 is prevented because dispenser cap assembly 25 and end cap assembly 20 are secured both rotationally and axially relative to body 15. Dispenser cap assembly 25 is secured by the engagement of male and female threads 16E', 45, latch tabs and ports 32, 36, bead 30D and bead seats 16C' and key seat 16D' and keys 31 Similarly, end cap 35 is secured by the engagement of male and female threads 16E, 35, latch tabs and ports 32, 36, beads 30D and bead seats 16C and key seat 16D and keys 31.

When assembled, squeezing body 15 does not affect or deform the tamper-resistant locking mechanism of bottle 10 because collars 30, 40 are separate from body 15. Further, collars 30, 40 are comprised of a more stiff material (i.e. a material having a higher elastic modulus) and reinforced by shoulders 16B, 16B'. Accordingly, squeezing collars 30, 40 will not disengage latch tabs 32 from latch port 36 without breaking one or more parts of bottle 10.

In some embodiments, bottle 10 is reusable. For example, bottle 10 may be disassembled using a tool 75 so that body 15, collars 30, 40, dispenser cap 45 and end cap 35 may each be cleaned separately before being reassembled with fresh contents in bottle 10. One exemplary embodiment of tool 75 is depicted in FIG. 9.

Tool 75 allows a user to simultaneously contact all of latch tabs 32 or latch tabs 32 with pegs 76, through latch ports 36, thereby disengaging latch tabs 32 or latch tabs 32 from latch ports 36 and un-securing of dispenser cap 45 or end cap 35 from collar 40 or collar 30 respectively. Furthermore, after dis-engaging latch tabs 32 or latch tabs 32 and while pegs 76 are still engaged with latch ports 36, rotating tool 75 allows female threads 35E or 45E to be unsecured from male threads 16E or 16E' respectively.

Figure 9:
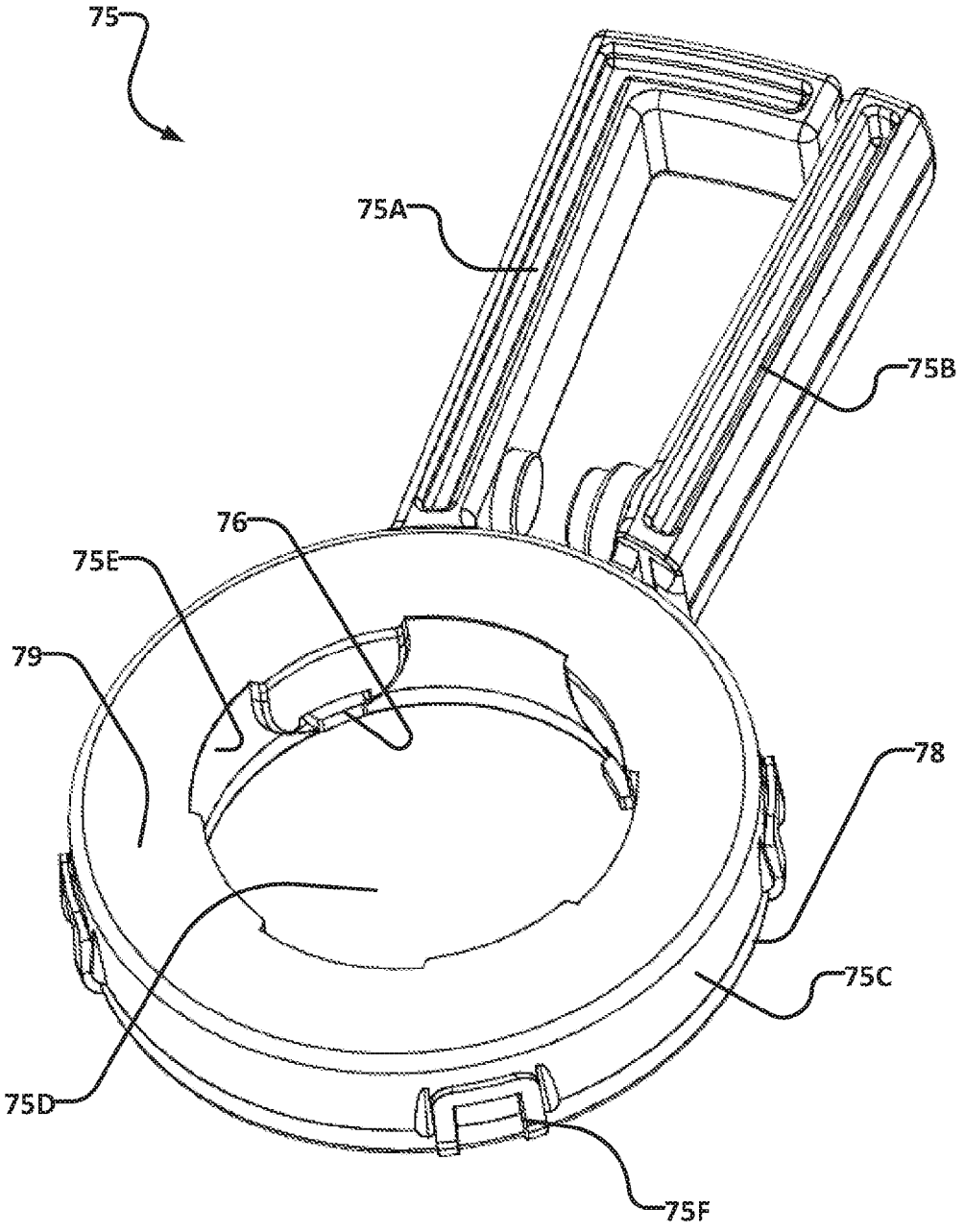
FIG. 9 is an isometric view of one embodiment of a tamper-resistant cap removal tool.

Tool 75, as depicted in FIG. 9 comprises a first handle 75A and a second handle 75B. First and second handles 75A, 75B are attached to an annular portion 75C. Annular portion 75C defines an aperture 75D for receiving one of dispenser cap assembly 25 or end cap assembly 20. Pegs 76 are extensible from annular portion 75C into aperture 75D for engaging latch tabs 32 or latch tabs 32. Pegs are extended from annular portion 75C by squeezing first handle 75A toward second handle 75B, as described in more detail below.

In some embodiments, an inner surface of annular portion 75C defines one or more channels 75C for receiving bossed keys 37 to thereby align pegs 76 with latch tabs 32 or latch tabs 32 respectively. Annular portion 75C may comprise a bottom cover 78 and a top cover 79 which are attached together by clips 75F. In other embodiments, bottom cover 78 and top cover 79 may be secured together using, screws, snaps, adhesive or any other suitable method. In some embodiments, the method of securing bottom cover 78 to top cover 79 is dependent upon the material of tool 75. For example, clips 75F may be suitable for a polymer tool 75 (although this is not mandatory) and screws may be suitable for a metal tool 75 (although this is not mandatory).

In some embodiments, in a first state, pegs 76 may be retracted within annular portion 75C such that dispenser cap assembly 25 or end cap assembly 20 can be received within aperture 75D. Pegs 76 may be caused to extend into aperture 75D by squeezing first handle 75A toward second handle 75B.

Figure 10:
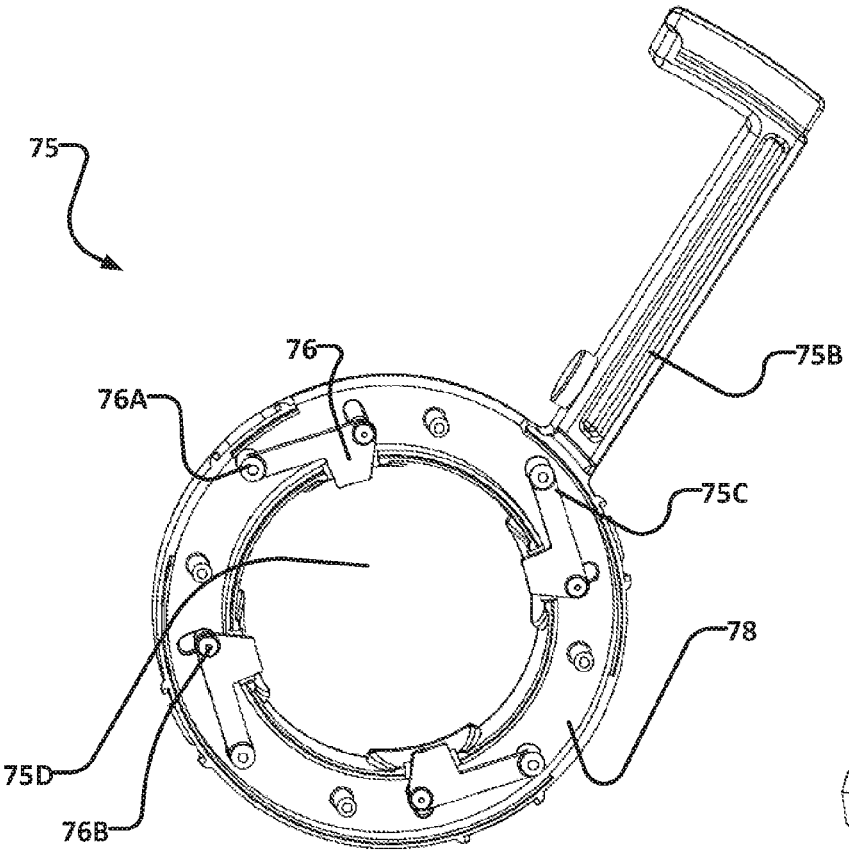
FIG. 10 is an isometric view of part of the tamper-resistant cap removal tool of FIG. 9.
Figure 11:
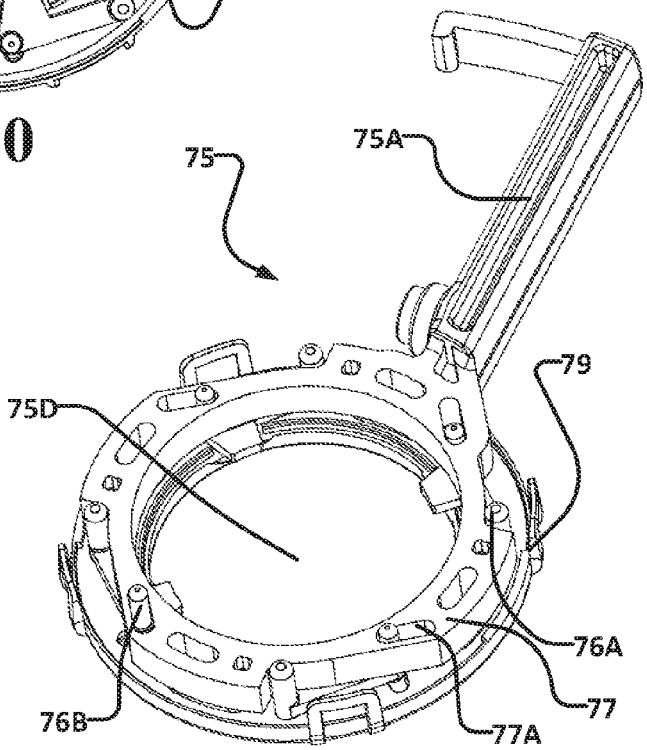
FIG. 11 is an isometric view of another part of the tamper-resistant cap removal tool of FIG. 9.

As best seen from FIG. 10, pegs 76 are attached to bottom cover 78 by peg pivot pins 76A and peg guide pins 76B which protrude through pegs 76 and are received in bottom cover 78 (and may also be received by top cover 79, although this is not clearly shown). Pegs 76 are allowed to pivot about pivot pins 76A between a first state, where pegs 76 are retracted within annular portion 75C and a second state where pegs 76 protrude (at least partially) into aperture 75D, as shown in FIGS. 9 to 11.

Pegs 76 may be pivoted between the first state and the second state when first handle 75A is brought toward second handle 75B. First handle 75A is attached to top cover 79 and as best seen from FIG. 10, second handle 75B is attached to peg guide 77. Peg guide 77 comprises angled peg guide slots 77A such that when first handle 75A is brought together with second handle 75B, peg guide 77 rotates relative to top cover 79 thereby forcing peg guide pins 76B to translate within peg guide slots 77A and cause pegs 76 to protrude into aperture 75D. Tool 75 may be spring loaded such that when first handle 75A and second handle 75B are released, pegs 76 retract out of aperture 75D.

In other embodiments, tool 75 may require each peg 76 to be manually extended into aperture 75D. In other embodiments, motorized means may be used to cause extension and retraction of pegs 76. In other embodiments, tool 75 may not include handles 75A and 75B and may be operated by holding annular portion 75C.

Interpretation of Terms

Unless the context clearly requires otherwise, throughout the description and the claims:

- "comprise", "comprising", and the like are to be construed in an inclusive sense, as opposed to an exclusive or exhaustive sense; that is to say, in the sense of "including, but not limited to".
- "connected", "coupled", or any variant thereof, means any connection or coupling, either direct or indirect, between two or more elements; the coupling or connection between the elements can be physical, logical, or a combination thereof.
- "herein", "above", "below", and words of similar import, when used to describe this specification shall refer to this specification as a whole and not to any particular portions of this specification.
- "or", in reference to a list of two or more items, covers all of the following interpretations of the word: any of the items in the list, all of the items in the list, and any combination of the items in the list.
- the singular forms "a", "an", and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back"," "top", "bottom", "below", "above", "under", and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a component, assembly, apparatus, tool, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions and sub-combinations as may reasonably be inferred. The scope of the claims should not be limited by the preferred embodiments set forth in the examples, but should be given the broadest interpretation consistent with the description as a whole.

What is claimed is:

1. A tamper-resistant squeeze bottle comprising:

a cap;

a body of an elastically deformable material, the body comprising:

at least one opening;

a screw coupling for engaging the cap to cover the opening; and a shoulder spaced apart from the cap;

a collar configured to non-rotationally engage the shoulder, the collar releasably engaged with the cap by a locking mechanism, the locking mechanism reversibly configurable between an engaged configuration wherein the cap is restricted from rotational movement relative to the body and a disengaged configuration wherein the screw coupling may be uncoupled by rotating the cap relative to the collar and the body, wherein the collar comprises a material having a higher elastic modulus than an elastic modulus of the elastically deformable material of the body.

2. A tamper-resistant squeeze bottle according to claim 1 wherein the locking mechanism comprises one or more latch tabs and one or more corresponding latch ports for receiving the one or more latch tabs thereby restricting the cap from rotational or axial movement relative to the body.

3. A tamper-resistant squeeze bottle according to claim 2, wherein the one or more latch tabs comprises four latch tabs and the one or more latch ports comprises four latch ports.

4. A tamper-resistant squeeze bottle according to claim 2, wherein the one or more latch tabs comprise beveled hooks.

5. A tamper-resistant squeeze bottle according to claim 2, wherein the one or more latch tabs and the one or more latch ports engage by a snap-fit.

6. A tamper-resistant squeeze bottle according to claim 1, wherein the collar further comprises a bead and the collar receiving shoulder further comprises a bead seat for receiving the bead and thereby preventing relative axial movement between the collar and the body when the bead and bead seat are engaged.

7. A tamper-resistant squeeze bottle according to claim 1, wherein the elastic modulus of the elastically deformable material of the body is less than approximately 1.0 GPa.

8. A tamper-resistant squeeze bottle according to claim 1, wherein the elastic modulus of the material of the collar is greater than approximately 0.8 GPa.

9. A tamper-resistant squeeze bottle according to claim 1, wherein the elastically deformable material of the body comprises polyethylene and the material of the collar comprises polypropylene.

10. A tamper-resistant squeeze bottle according to claim 1, wherein the at least one opening of the body is provided by first and second openings at opposing ends of the body.

11. A tamper-resistant squeeze bottle comprising:

a body of an elastically deformable material, the body comprising:

at least one opening;

a coupling for engaging a cap to cover the opening; and a shoulder spaced apart from the cap;

a collar configured to non-rotationally engage the shoulder, the collar releasably engaged with the cap by a locking mechanism such that the cap is restricted from rotational or axial movement relative to the body, wherein the collar comprises a material having a higher elastic modulus than an elastic modulus of the elastically deformable material of the body;

wherein the locking mechanism comprises one or more latch tabs and one or more corresponding latch ports for receiving the one or more latch tabs thereby restricting the cap from rotational or axial movement relative to the body;

a tool comprising a squeezable handle, an annular portion that defines an aperture for receiving the collar and the cap and one or more pegs extendable from the annular portion into the aperture;

wherein squeezing the handle causes the one or more pegs to extend into the aperture for disengaging the one or more latch tabs from the one or more latch ports.

12. A tamper-resistant squeeze bottle according to claim 11, the cap comprising one or more bossed keys protruding radially outward from the cap and the tool comprising one or more channels for receiving the one or more bossed keys to align the plurality of pegs with the plurality of latch ports.

13. A tamper-resistant squeeze bottle comprising a squeezable tubular body having first and second openings at opposing ends thereof and first and second shoulders respectively spaced apart from the first and second openings, first and second caps respectively covering the first and second openings and first and second collars associated respectively with the first and second caps, the first and second collars covering a portion of the body between the corresponding cap and shoulder and non-rotationally engaged to the corresponding shoulder and the cap, wherein each collar is releasably engaged with the corresponding cap with a locking mechanism, the locking mechanism reversibly configurable between an engaged configuration wherein the locking mechanism restricts the corresponding cap from rotational movement relative to the corresponding collar and a disengaged configuration wherein the corresponding cap is free to be rotated relative to the corresponding collar.

14. A tamper-resistant squeeze bottle comprising a deformable squeezable body having an opening at one end thereof;

a cap covering the opening;

a shoulder on the body and spaced apart from the cap;

a collar releasable coupled to the cap by a locking mechanism, the collar trapped between the cap and the shoulder, the collar non-rotationally engaged to the shoulder, the locking mechanism reversibly configurable between an engaged configuration wherein the locking mechanism restricts the cap from rotational movement relative to the collar and a disengaged configuration wherein the cap is free to be rotated relative to the collar.

15. A tamper-resistant squeeze bottle of claim 14, wherein the collar covers the portion of the body between the cap and shoulder.

16. A tamper-resistant squeeze bottle of claim 15, wherein the collar is stiffer than the portion of the body between the cap and the shoulder.

17. A tamper-resistant squeeze bottle comprising:

a cap;

a body of an elastically deformable material, the body comprising:

at least one opening;

a screw coupling for engaging the cap to cover the opening; and a shoulder spaced apart from the cap;

a collar configured to non-rotationally engage the shoulder, the collar releasably engaged with the cap by a locking mechanism comprising a plurality of resiliently deformable latch tabs extending from the collar in an axial direction toward the cap, the locking mechanism reversibly configurable between an engaged configuration wherein the latch tabs engage corresponding latch ports in the cap such that the cap is restricted from rotational movement relative to the body and a disengaged configuration wherein the latch tabs are compressed radially inwardly out of engagement with the latch ports such that the screw coupling may be uncoupled by rotating the cap relative to the collar and the body, wherein the collar comprises a material having a higher elastic modulus than an elastic modulus of the elastically deformable material of the body.

18. A tamper-resistant squeeze bottle according to claim 17, wherein the one or more latch tabs comprises four latch tabs and the one or more latch ports comprises four latch ports.

19. A tamper-resistant squeeze bottle according to claim 17, wherein the one or more latch tabs comprise beveled hooks.

20. A tamper-resistant squeeze bottle according to claim 17, wherein the one or more latch tabs and the one or more latch ports engage by a snap-fit.

* * * * *